US007486257B2

(12) United States Patent
Kim et al.

(10) Patent No.: US 7,486,257 B2
(45) Date of Patent: Feb. 3, 2009

(54) PLASMA DISPLAY PANEL AND DRIVING METHOD THEREOF

(75) Inventors: Jin-Sung Kim, Suwon-si (KR); Woo-Joon Chung, Suwon-si (KR); Seung-Hun Chae, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 647 days.

(21) Appl. No.: 10/984,075

(22) Filed: Nov. 8, 2004

(65) Prior Publication Data

US 2005/0110708 A1 May 26, 2005

(30) Foreign Application Priority Data

Nov. 10, 2003 (KR) ..... 10-2003-0079094

(51) Int. Cl.
*G09G 3/28* (2006.01)

(52) U.S. Cl. ..... 345/60; 315/169.4

(58) Field of Classification Search ..... 345/60; 315/169.4

See application file for complete search history.

(56) References Cited

U.S. PATENT DOCUMENTS

| | | | | |
|---|---|---|---|---|
| 2002/0140639 | A1* | 10/2002 | Sakita | 345/60 |
| 2003/0025459 | A1* | 2/2003 | Lee et al. | 315/169.3 |

FOREIGN PATENT DOCUMENTS

| | | |
|---|---|---|
| JP | 3-147418 | 6/1991 |
| JP | 8-234695 | 9/1996 |
| JP | 2000-172215 | 6/2000 |
| JP | 2000-305520 | 11/2000 |
| JP | 2000-338934 | 12/2000 |
| JP | 2002-149107 | 5/2002 |
| JP | 2002-297090 | 10/2002 |
| JP | 2002-333860 | 11/2002 |
| JP | 2003-15593 | 1/2003 |
| JP | 2003-228320 | 8/2003 |
| JP | 2003-280574 | 10/2003 |

OTHER PUBLICATIONS

Patent Abstracts of Japan, Publication No. 03-147418; Publication Date: Jun. 24, 1991; in the name of Atsushi Hiraishi et al.
Patent Abstracts of Japan, Publication No. 08-234695; Publication Date: Sep. 13, 1996; in the name of Iwao Arimori.

(Continued)

*Primary Examiner*—Amr Awad
*Assistant Examiner*—Yong Sim
(74) *Attorney, Agent, or Firm*—Christie, Parker & Hale, LLP

(57) ABSTRACT

A plasma display panel having a plurality of first electrodes and a driver for applying scan signals to the first electrodes in order, the driver having a plurality of selection circuit groups, each selection circuit group having a plurality of selection circuits. Driving signals are applied to the first electrodes through the output ends of selection circuits in one selection circuit group, the output ends being connected in parallel.

8 Claims, 6 Drawing Sheets

OTHER PUBLICATIONS

Patent Abstracts of Japan, Publication No. 2000-172215; Publication Date: Jun. 23, 2000; in the name of Tadayoshi Kosaka et al.

Patent Abstracts of Japan, Publication No. 2000-338934; Publication Date: Dec. 8, 2000; in the name of Yasunobu Hashimoto.

Patent Abstracts of Japan, Publication No. 2002-149107; Publication Date: May 24, 2002; in the name of Takayoshi Nagai.

Patent Abstracts of Japan, Publication No. 2002-297090; Publication Date: Oct. 9, 2002; in the name of Koichi Sakida.

Patent Abstracts of Japan, Publication No. 2002-333860; Publication Date: Nov. 22, 2002; in the name of Shigeo Ide et al.

Patent Abstracts of Japan, Publication No. 2003-015593; Publication Date: Jan. 17, 2003; in the name of Shigeo Ide et al.

Patent Abstracts of Japan, Publication No. 2003-228320; Publication Date: Aug. 15, 2003; in the name of Koji Ito et al.

Patent Abstracts of Japan, Publication No. 2003-280574; Publication Date: Oct. 2, 2003; in the name of Makoto Onozawa et al.

Patent Abstracts of Japan, Publication No. 2000-305520; Date of Publication: Nov. 2, 2000; in the name of Saburo Watanabe et al.

* cited by examiner

PLASMA DISPLAY PANEL AND DRIVING METHOD THEREOF

CROSS REFERENCE TO RELATED APPLICATION

This application claims priority to and the benefit of Korea Patent Application No. 10-2003-0079094 filed on Nov. 10, 2003 in the Korean Intellectual Property Office, the entire content of which is incorporated herein by reference.

BACKGROUND OF THE INVENTION (a) Field of the Invention

The present invention relates to a plasma display panel (PDP). More particularly, the present invention relates to a driving circuit of the PDP.

(b) Description of the Related Art

Recently, PDPs have been highlighted among flat display devices due to high brightness, emission efficiency, and wide viewing angle. The PDP is a flat display device for displaying characters or images using plasma caused by gas discharge, and several tens to several millions of pixels are arranged in a matrix format on the PDP according to the PDP size.

FIG. 1 is a partial perspective view of a PDP. FIG. 2 shows an arrangement of electrodes in the PDP. As shown in FIG. 1, the PDP includes two glass substrates 1, 6 which are arranged in a face-to-face relationship. On first substrate 1, pairs of scan electrode 4 and sustain electrode 5, which are covered with dielectric layer 2 and protective layer 3, are arranged in parallel. On second substrate 6, a plurality of address electrodes 8, which are covered with insulating layer 7, are arranged. Barrier ribs 9 are formed in parallel with address electrodes 8 on insulating layer 7. Fluorescent material 10 is formed on the surface of insulating layer 7 and on both sides of barrier ribs 9. Glass substrates 1, 6 are arranged in a face-to-face relationship with discharge space 11 formed therebetween, such that scan electrodes 4 and sustain electrodes 5 lie in a direction perpendicular to address electrodes 8. Discharge space 11 at intersections of address electrodes 8 and the pairs of scan electrode 4 and sustain electrode 5 forms discharge cells 12.

As shown in FIG. 2, the PDP has a pixel matrix in an m×n matrix format. A plurality of address electrodes $A_1$ to $A_m$ are arranged in a column direction, and a plurality of scan electrodes $Y_1$ to $Y_n$ and a plurality of sustain electrodes $X_1$ to $X_n$ are alternately arranged in a row direction.

Generally, in the PDP one frame is divided into a plurality of subfields, and is driven. Grays of the PDP can be expressed by a combination of the subfields, and generally, each subfield includes a reset period, an address period, and a sustain period. The reset period is a period for erasing wall charges that have been formed by a previous sustain discharge, and setting up a new wall charge in order to stably perform a next address discharge. The address period is a period for selecting cells being turned on and cells being turned off, and accumulating a wall charge on cells being turned on (addressed cell). The sustain period is a period for performing a sustain discharge to display a video image on an addressed cell. Here, "wall charge" means a charge that is formed on a wall close to each electrode of the discharge cell and is accumulated on the electrode. The wall charge is described as being "formed" or "accumulated" on the electrode, although the wall charge does not actually contact the electrodes. Further, "wall voltage" means a potential difference formed on the wall of the discharge cell by the wall charge.

An address operation of the PDP is performed by the operation of a scan IC and an address IC, which include a plurality of selection circuits having two switches connected serially. Further, the output of the scan selection circuit corresponds to the scan electrode (Y electrode) and the output of the address selection circuit corresponds to the address electrode. Generally, one driver IC includes a plurality of selection circuits. However, hereinafter one driver IC is understood to include one selection circuit for convenience.

FIG. 3 shows a connection diagram of a scan IC and a Y electrode according to a conventional circuit. As shown in FIG. 3, the output of SCAN IC 1 is coupled to scan electrode Y1, and the output of SCAN IC2 is coupled to scan electrode Y2.

Because the size of panels has gradually been enlarged in recent years, the requirement for capacity of the circuit elements has also gradually increased. Thus, the capacity of a driver IC (scan IC and address IC) also needs to be increased. In particular, a driver IC that is capable of dealing with a large quantity of current is required, since the driving current for a 70 inch grade PDP is three times greater than the driving current for a 40 inch grade PDP. However, the production amount of the large sized PDP is smaller than that of the 40 inch grade PDP, thus the development of an exclusive driver IC for the large size PDP is not advantageous with regard to cost.

SUMMARY OF THE INVENTION

In accordance with the present invention, a driving circuit of a plasma display panel for driving a large PDP by using a small capacity driver IC is provided.

In one aspect of the present invention a plasma display panel is provided including: a panel having a plurality of first electrodes; and a driver for applying scan signals to the first electrodes in order, the driver having a plurality of selection circuit groups, each selection circuit group being composed of a plurality of selection circuits. The scan signals are applied to the first electrodes through output ends of the selection circuits in one selection circuit group, the output ends being connected in parallel.

Each selection circuit may include a first switch coupled to a first power source supplying power corresponding to the scan signals, and a second switch coupled to a second power source; and driving signals are applied to the first electrode when the first switches of each selection circuit in one selection circuit group are turned on at the same time and the second switches are turned off at the same time.

Further, the outputs of the selection circuits may be floated by turning off all switches of a plurality of selection circuit groups during a predetermined time, before a next driving signal is applied to a plurality of the first electrodes; when the driving signals are applied to a plurality of the first electrodes in order.

In addition, the outputs of the selection circuits may be floated by turning off all switches of a selection circuit group for applying a previous driving signal and a selection circuit group for applying a next driving signal during a predetermined time, before the next driving signal is applied to a plurality of the first electrodes, when driving signals are applied a to plurality of the first electrodes in order.

In exemplary embodiments the first electrodes are scan electrodes or address electrodes.

In accordance with another aspect of the present invention a driving method of a plasma display panel having a plurality of first electrodes and a driver for applying a driving signal to a plurality of first electrodes is provided, wherein the drive has a plurality of selection circuit groups, each selection circuit group being composed of a plurality of selection circuits. The driving method includes: applying a driving signal to one first electrode through outputs of a plurality of selection circuits in one selection circuit group being connected in parallel, wherein the application of the driving signal to the one first electrode is performed in order for a plurality of first electrodes; floating outputs of the selection circuits in a first selection circuit group for outputting a previous driving signal and a second selection circuit group for outputting a next driving signal during a predetermined time, before the next driving signal is applied to a plurality of the first electrodes.

Here, the driving method of the plasma display panel may float the outputs of all selection circuits in a plurality of selection circuits during the predetermined time. Further, the driving method of the plasma display panel operates the selection circuits in the selection circuit groups normally except for the first and the second selection circuit groups.

DETAILED DESCRIPTION

Figure 1:
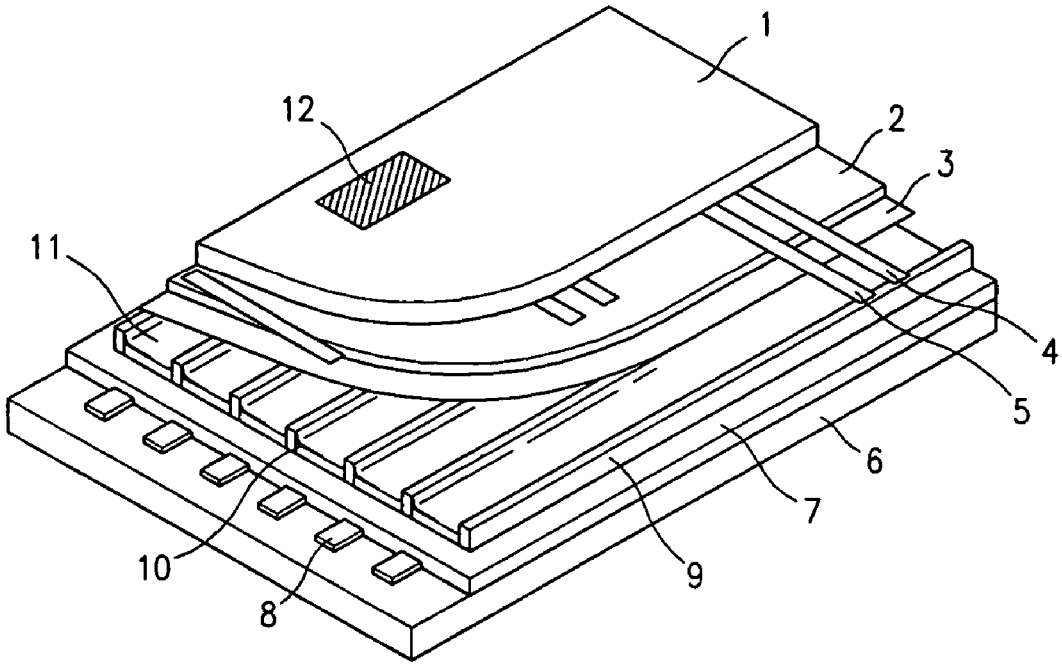
FIG.1(Prior Art)
FIG. 1 is a partial perspective view of a PDP.
Figure 2:
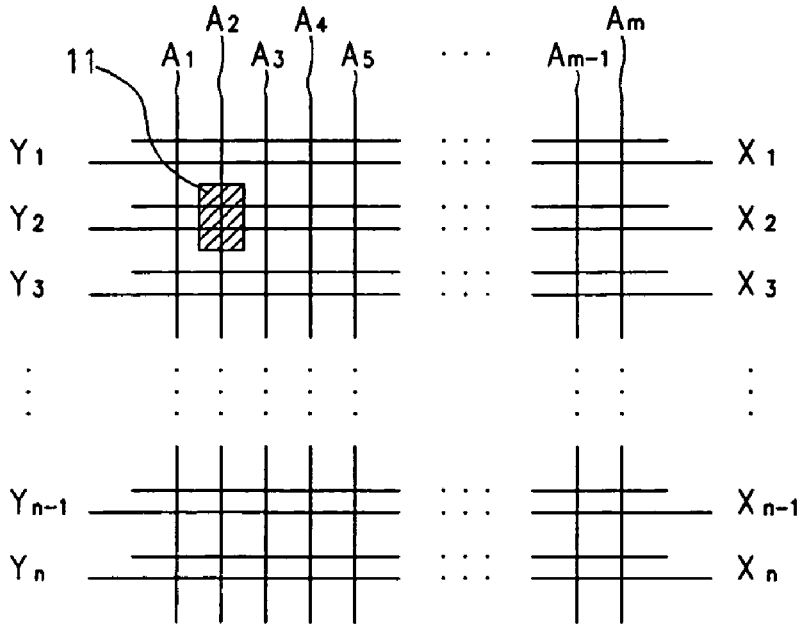
FIG.2(Prior Art)
FIG. 2 shows an arrangement of electrodes in the PDP of FIG. 1.
Figure 3:
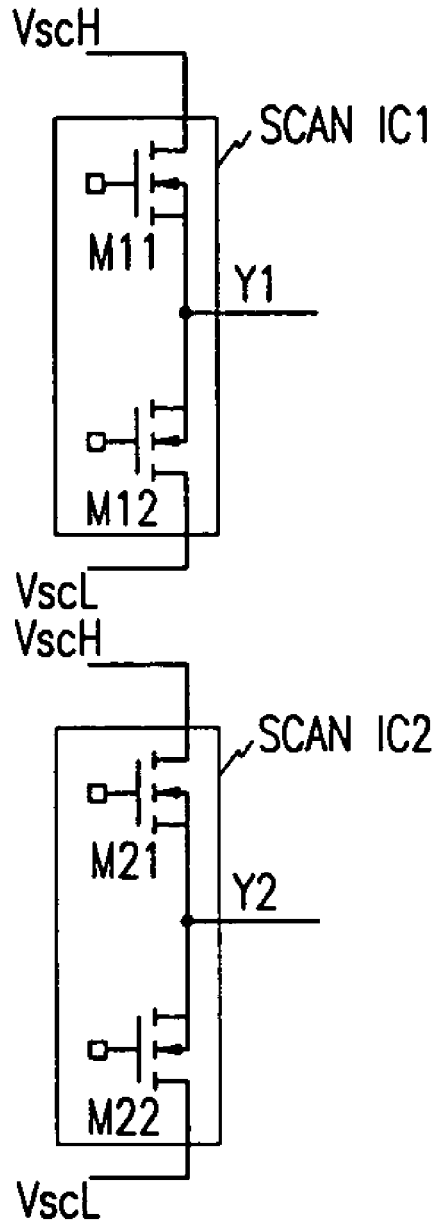
FIG.3(Prior Art)
FIG. 3 shows a schematic diagram of a conventional scan IC and scan electrode connection.
Figure 4:
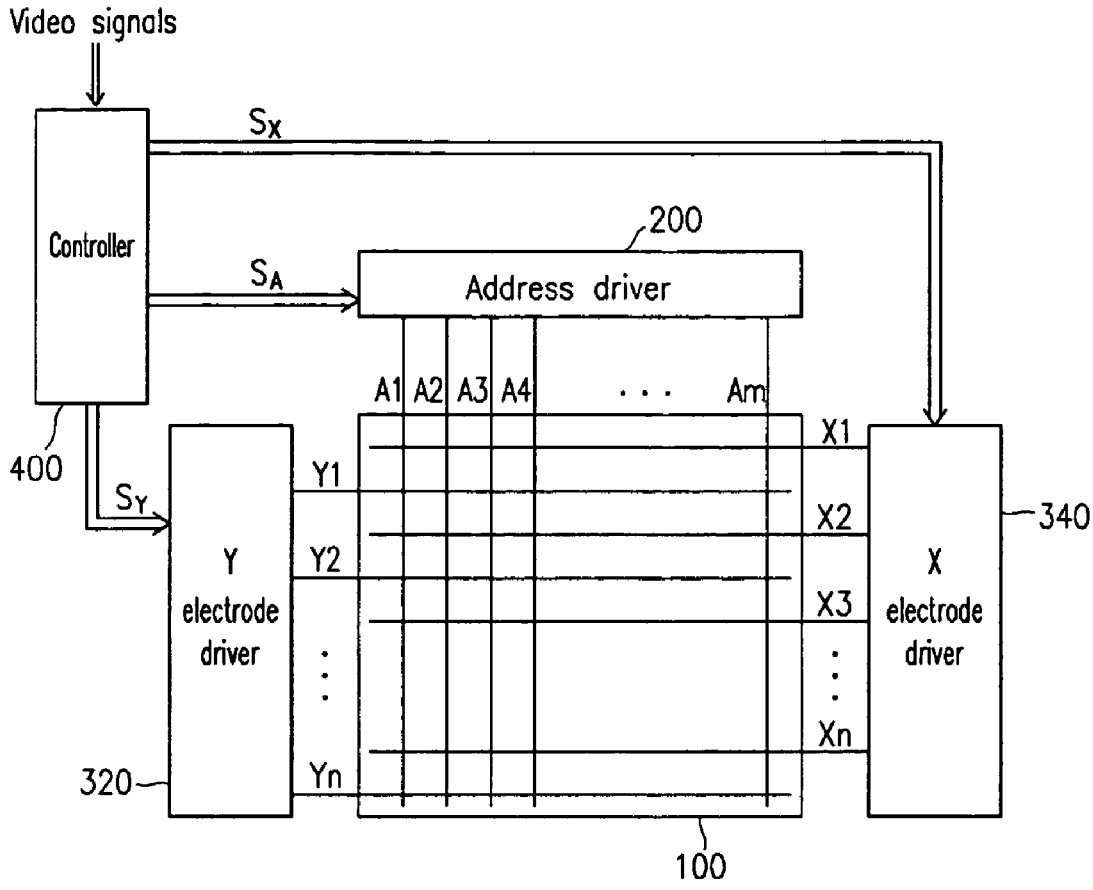
FIG. 4 shows a plasma display panel according to an exemplary embodiment of the present invention.

Referring now to FIG. 4, the plasma display panel device includes plasma display panel 100, address driver 200, Y electrode driver 300, X electrode driver 300, and controller 400.

Plasma display panel 100 includes a plurality of address electrodes $A_1$ to $A_m$ extended in a row direction, and a plurality of pairs of first electrodes (hereinafter "Y electrode") $Y_1$ to $Y_n$ and second electrodes (hereinafter "X electrode") $X_1$ to $X_n$ extended in a column direction.

Address driver 200 receives address driving control signal $S_A$ from controller 400, and applies a data signal for display to each address electrode $A_1$ to $A_m$ to select a discharge cell that is to be displayed.

Y electrode driver 320 receives Y electrode driving signal $S_Y$ from controller 400 and applies the data signal to the Y electrode. X electrode driver 340 receives X electrode driving signal $S_X$ from controller 400 and applies the data signal to the X electrode.

Controller 400 receives a video signal externally, and generates address driving control signal $S_A$, Y electrode driving signal $S_Y$, and X electrode driving signal $S_X$, and transfers each signal to address driver 200, Y electrode driver 320, and X electrode driver 340, respectively.

Figure 5:
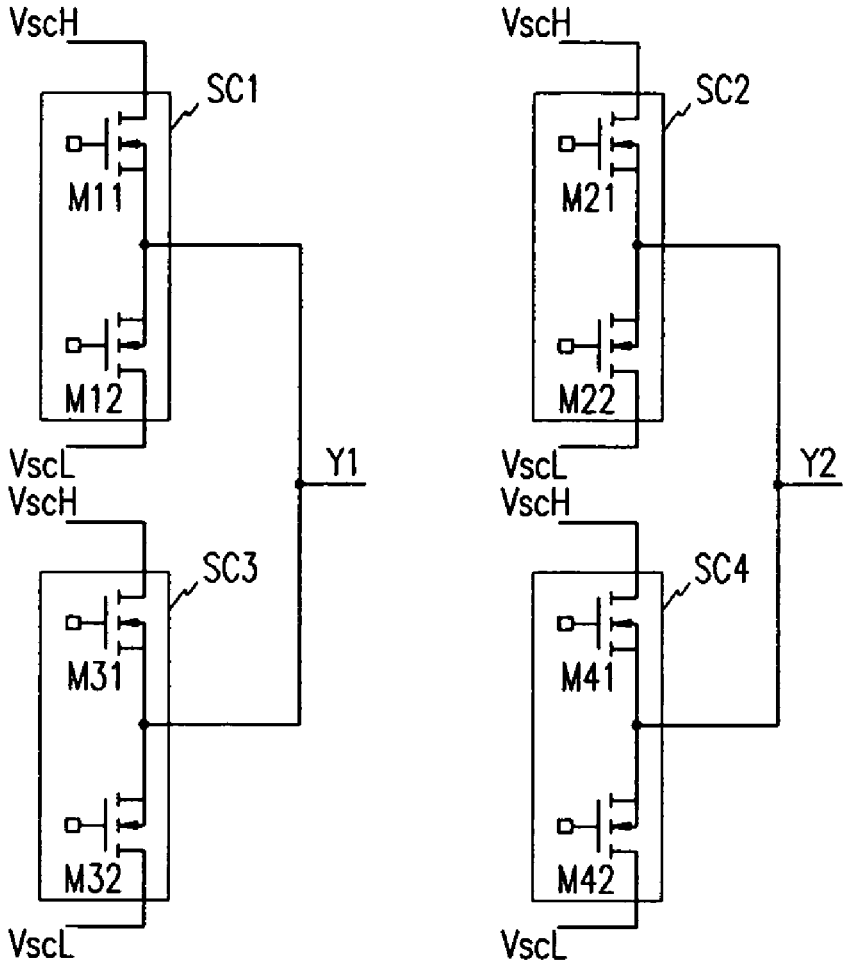
FIG. 5 shows a schematic diagram of a scan IC and a scan electrode according to an exemplary embodiment of the present invention.

FIG. 5 shows a connection diagram of a selection circuit in a scan IC and a Y electrode which are included in Y electrode driver 320 according to a first exemplary embodiment of the present invention. As shown in FIG. 5, Y electrode driver 320 includes two selection circuits SC1, SC3, of which outputs are connected in parallel to one Y electrode Y1. In the same manner, the outputs of two selection circuits SC2, SC4 are connected in parallel to one Y electrode Y2. When a scan voltage is applied to the Y electrode though the above circuit, an on/off operation of switches M11, M31 is performed at the same time, and an on/off operation of switches M12, M32 is performed at the same time. Then, the current at the switches can be reduced by 50%, since the two switches are connected in parallel.

Further, although the same model of switches may be used for the scan IC selection circuit, the on/off switching time for each switch may be slightly different, thus it is possible for the switch being turned on and the switch being turned off to be on at the same time.

For example, in FIG. 5, the output of Y electrode Y1 is changed from low to high, and the output of Y electrode Y2 is changed from high to low, when a scan pulse is applied to Y electrode Y1 and then is applied to Y electrode Y2. Thus, switches M12 and M32 are changed from on state to off state, and switches M11, M31 are changed from an off state to an on state. Further, switches M21, M41 are changed from an on state to an off state, and switches M22, M42 are changed from an off state to an on state.

Further, if the switch timing of switches M31, M32 is faster than the switch timing of switches M11, M12, switch M31 can be turned off and switch M32 can be turned on, before switch M11 is turned off and switch M12 is turned on, when the scan pulse is applied to Y electrode Y1. In the same manner, switch M11 can be turned on and switch M12 can be turned off, before switch M31 is turned on and switch M32 is turned off, when the scan pulse is applied to Y electrode Y2. As a result, switches M11, M32 could be turned on at the same time, or switches M12, M31 could be turned on at the same time, thus causing the circuit to be short circuited. Thus, the selection circuit cannot output a desired waveform to electrodes Y1, Y2.

To solve the problem, the present invention provides a method wherein the outputs of all selection circuits are floated by allowing the outputs of all selection circuits to be at high impedance states, and then applying a scan pulse to the scan electrode when the scan pulse is applied to the scan electrode. Then, all switches are in an off state while the outputs of the selection circuits maintain high impedance states. Thus, a short circuit due to switch timing can be prevented.

Figure 6:
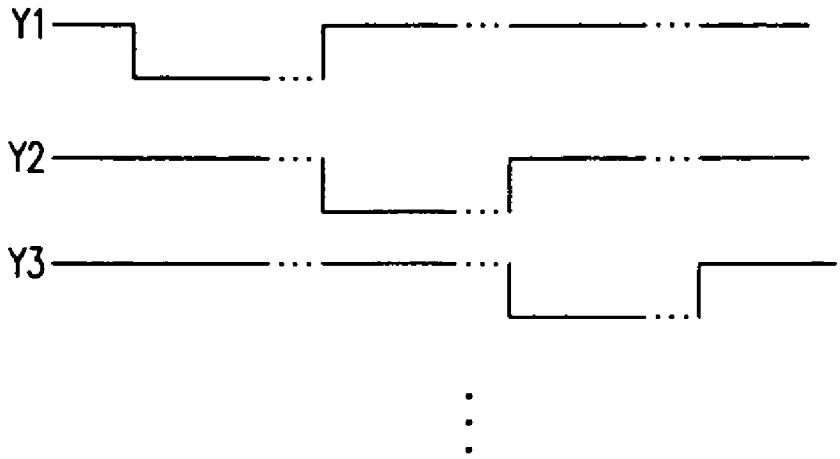
FIG. 6 shows a waveform being input to a scan electrode according to a driving method of a scan IC of an exemplary embodiment of the present invention.

FIG. 6 shows a waveform being input to scan electrodes (Y1, Y2, Y3 . . . ) according to a driving method of a selection circuit of the first exemplary embodiment of the present invention. The dotted line of FIG. 6 indicates that the output of the selection circuit is at a high impedance state, and the output voltage is floated.

The first exemplary embodiment discloses an example in which outputs of all selection circuits are in a high impedance state whenever the scan pulse is applied to the scan electrode. Otherwise, only the output of the selection circuit connected to the scan electrode of which voltage is changed can be in the high impedance state.

Figure 7:
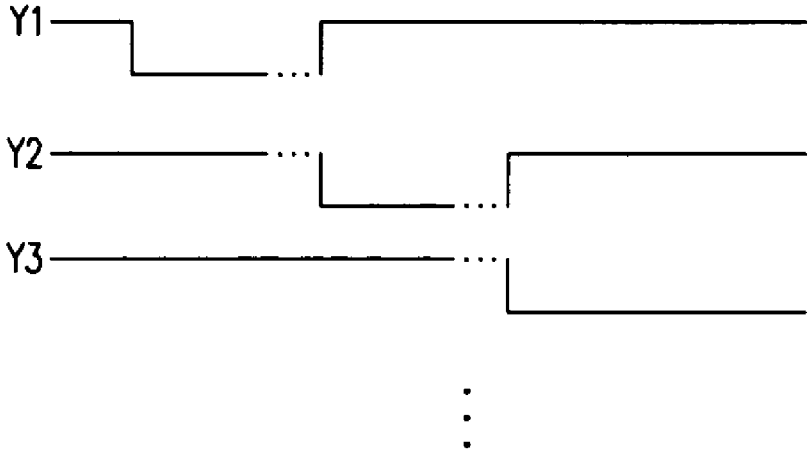
FIG. 7 shows a waveform being input to a scan electrode according to a driving method of a scan IC of another exemplary embodiment of the present invention.

FIG. 7 shows a waveform being input to the scan electrodes (Y1, Y2, Y3 . . . ) by a driving method of a scan circuit according to a second exemplary embodiment of the present invention. As shown in FIG. 7, the outputs of the selection circuits for driving Y electrodes Y1, Y2 are made to be in a high impedance state for a predetermined time, when the scan pulse is applied to Y electrode Y1 but the scan pulse is not applied to Y electrode Y2. At this time, the voltages of Y electrodes Y1, Y2 are floated. At this time, the output of the selection circuit for driving Y electrode Y3 is maintained at the normal state, since the voltage variation does not occur at Y electrode Y3.

In the same manner, the outputs of the selection circuits for driving Y electrodes Y2, Y3 are made to be in high impedance state for a predetermined time, when the scan pulse is applied to Y electrode Y2 but the scan pulse is not applied to Y electrode Y3. At this time, the voltages of Y electrodes Y2, Y3 are floated. Also at this time, the output of the selection circuit for driving Y electrode Y1 is maintained at the normal state, since the voltage variation does not occur at Y electrode Y1.

Figure 8:
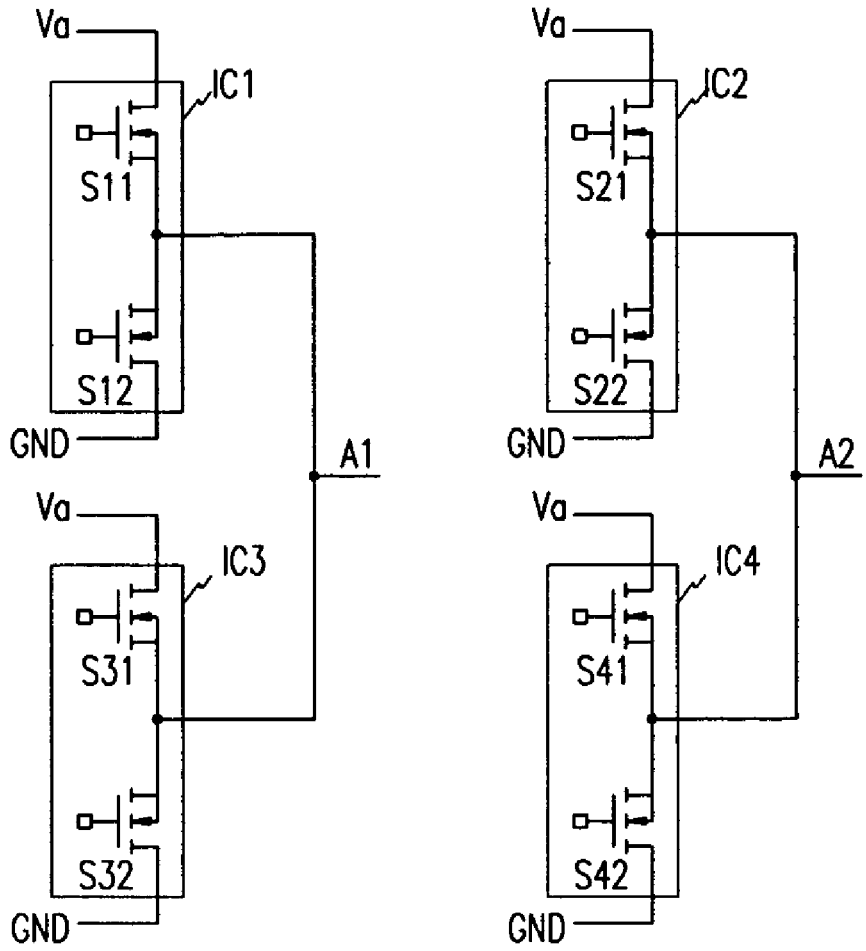
FIG. 8 shows a schematic diagram of a address IC and a address electrode according to an exemplary embodiment of the present invention.

The first and second exemplary embodiments disclose the selection circuit in the scan IC and scan electrode (Y electrode). However, the present invention can be also applied to the selection circuit in the address IC and address electrode. FIG. 8 shows a connection diagram of a selection circuit in a address IC and a address electrode according to a first and second exemplary embodiment of the present invention.

Further, the first and second exemplary embodiments disclose that two selection circuits are connected in parallel to drive one electrode. However, at least three selection circuits can also be connected in parallel to drive one electrode.

As described above, the present invention connects two selection circuits in parallel to increase a driving current and a power capacity, and drives one scan electrode or address electrode. Thus, the present invention can drive a large PDP by using small capacity drivers which are used for driving small PDPs.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A plasma display panel comprising:

a panel having a plurality of first electrodes; and a driver for applying driving signals to the first electrodes in order, the driver having a plurality of selection circuit groups, each selection circuit group comprising a plurality of selection circuits, each of the plurality of selection circuits having switches, wherein the driving signals are applied to the first electrodes through output ends of selection circuits in one selection circuit group, the output ends being coupled in parallel, and wherein outputs of the selection circuits are floated by turning off all of the switches of the plurality of selection circuits of a first selection circuit group and a second selection circuit group during a same time window, the first selection circuit group for applying a previous driving signal and the second selection circuit group for applying a next driving signal, the switches being turned off during the same time window immediately before the next driving signal is applied to the plurality of first electrodes when driving signals are applied to the plurality of first electrodes in order.

2. The plasma display panel of claim 1, wherein:

each selection circuit comprises a first switch coupled to a first power source supplying power corresponding to the driving signals, and a second switch coupled to a second power source; and the driving signals are applied to each of the first electrodes when the first switches of each selection circuit in one selection circuit group are turned on at the same time and the second switches are turned off at the same time.

3. The plasma display panel of claim 2, wherein outputs of the selection circuits are floated by turning off all switches of the plurality of selection circuits in each of the plurality of selection circuit groups during a time window, before a next driving signal is applied to the plurality first electrodes, when the driving signals are applied to the plurality of first electrodes in order.

4. The plasma display panel of claim 1, wherein the first electrodes are scan electrodes and the driving signals are scan signals.

5. The plasma display panel of claim 1, wherein the first electrodes are address electrodes and the driving signals are address signals.

6. A driving method of a plasma display panel comprising a plurality of first electrodes and a driver for applying a driving signal to the plurality of first electrodes, the driver having a plurality of selection circuit groups, each selection circuit group having a plurality of selection circuits coupled in parallel; comprising:

applying a driving signal to each of the plurality of first electrodes through outputs of the plurality of selection circuits in said each selection circuit group, the driving signal being applied to the plurality of first electrodes in order; and floating outputs of the plurality of selection circuits in a first selection circuit group for outputting a previous driving signal and a second selection circuit group for outputting a next driving signal during a same time window, the outputs of the plurality of selection circuits being floated during the same time window immediately before the next driving signal is applied to the plurality of first electrodes when driving signals are applied to the plurality of first electrodes in order.

7. The driving method of the plasma display panel of claim 6, wherein outputs of all of the plurality of selection circuits in each of the plurality of selection circuit groups are floated during the time window.

8. The driving method of the plasma display panel of claim 6, wherein outputs of the plurality of selection circuits are floated only in the first selection circuit group for outputting the previous driving signal and in the second selection circuit group for outputting the next driving signal.

* * * * *